United States Patent [19]

Martinez

[11] Patent Number: 4,577,771

[45] Date of Patent: Mar. 25, 1986

[54] TEARABLE BOTTLE CAPS

[76] Inventor: Francisco P. Martinez, Callejon de Pino Suarez 1636, Col. Libertad, Tijuana, B. C., Mexico, D. F., Mexico

[21] Appl. No.: 693,129

[22] Filed: Jan. 22, 1985

[51] Int. Cl.[4] ..... B65D 41/48

[52] U.S. Cl. ..... 215/256; 215/319; 215/321

[58] Field of Search ..... 215/256, 319, 321, 254

[56] References Cited

U.S. PATENT DOCUMENTS

| | | | |
|---|---|---|---|
| 3,109,547 | 11/1963 | Wood | 215/256 |
| 3,979,002 | 9/1976 | Faulstich | 215/256 |
| 4,037,746 | 7/1977 | Ver Hage | 215/256 |
| 4,303,167 | 12/1981 | Martinez | 215/256 |
| 4,437,593 | 3/1984 | Bullock | 215/256 X |

*Primary Examiner*—Donald F. Norton
*Attorney, Agent, or Firm*—McGlew and Tuttle

[57] ABSTRACT

A tearable bottle cap comprises a top planar disk, an approximately cylindrical skirt depending from said planar disk to snugly fit around the neck of said bottle, a first inner bead extending throughout the circumference of said skirt at a predetermined distance from the lower end of said skirt, to engage the lower portion of the upper bead of the bottle neck, a second inner bead extending throughout the circumference of said skirt at a predetermined distance above said first inner bead, in order to engage the upper portion of the upper bead of the bottle neck, a plurality of vertical, radially inwardly directed lugs projecting from the corner between said disk and said skirt and having their lower ends embedded in said second inner bead to be reinforced thereby, said lugs having a width such that they will accommodate therebetween the upper terminal portion of a screw threaded neck bottle, said radially inwardly directed lugs also serving as shock absorbers when the cap is used on unthreaded neck bottles not having a screw threaded terminal portion.

7 Claims, 4 Drawing Figures

TEARABLE BOTTLE CAPS

FIELD OF THE INVENTION

The present invention refers to improvements in bottle caps and, more particularly, it is related to tearable bottle caps of the type used for large capacity bottles.

BACKGROUND OF THE INVENTION

Tearable bottle caps comprising a top planar disk and an approximately cylindrical skirt depending from said planar disk to snugly fit around the neck of the bottle and having a pull tab and a score line starting from the lower edge of said skirt in order to enable the tearing of said tab along said score line so as to loosen the cap from the bottle neck, have been known for long.

For instance, British patent specification No. 816,787 published July 11, 1959 discloses a bottle cap having a pull tab and a slant core line starting from the lower end of the skirt and extending up to the portion of the skirt that is provided with an internal bead being used to be snapped over a circumferential flute provided near the upper edge of the bottle neck, which upper edge is sealed by a plurality of circumferential ribs provided on the inner surface of the top disk of the cap. This cap, however, while providing the principle of opening the cap by means of a pull tab and a score line slanting from the bottom of the cap and up to the bead portion thereof, is deficient in that it relies, for the sealing engagement of the cap with the bottle neck, merely on the provision of said internal bead and the provision of said circumferential ribs that supposedly should seal on the upper edge of the bottle neck, but this arrangement is not quite efficient, because it is necessary to provide the flute on the neck of the bottle in a very accurate position in order to enable sealing of the bottle neck against the circumferential ribs of the top disk of the cap. On the other hand, and while said ribs may be sealingly engaged against new bottles, it is quite clear that, when the bottles are spoiled in use, the sealing engagement would also be materially useless and, therefore, this type of caps is not adequate for bottles of the type which are interchanged or refilled for marketing purposes.

Another tearable cap for bottle necks is also disclosed in U.S. Pat. No. 3,032,226 to Terwilliger, patented May 1, 1962. This cap for the first time provides for a vertically extending pull tab and a vertical score line to tear the cap, but again relies on the provision of an internal bead provided at the lower edge of the skirt of the cap and effects the sealing engagement with the bottle neck by means of the provision of a channel-like section which comprises an inner circumferential flange which is engaged within the top of the flask, whereby this engagement mainly relies on the force exerted by the inner cylindrical flange on the inner surface of the wall of the bottle neck, which cannot be very strong unless the contents of the flask are under pressure. This cap, therefore, is not useful for common type large capacity bottles and, on the other hand, the vertical score line provided therein is also very inefficient to tear the cap, with the consequent disadvantages caused thereby. Also, the manufacture of a cap of the characteristics disclosed by Terwilliger is extremely difficult, particularly considering the modern methods of injection molding of this type of caps.

One other tearable cap for bottle necks is described and shown in U.S. Pat. No. 3,120,900 to Faulstich, patented Feb. 11, 1964, which is a combination of the above mentioned patents, in that it provides a vertically extending pull tab as in U.S. Pat. No. 3,032,226 and a slant score line as in British specification No. 816,787, but also provides a score line which extends throughout the circumference of the cap, so that the tearing of said cup may be complete around the circumference thereof. The sealing engagement of this cap, however, leaves much to desire because it relies on an accurately placed dovetail engagement between the cap and the bottle neck, whereby this type of cap is more adequate for plastic containers and is quite unsuitable for rigid containers, regardless of the fact that the sealing engagement is also provided by an internal circumferential bead provided on the skirt of the cap. While said bead efficiently holds either the corresponding groove of the plastic container or the corresponding bead of the bottle neck, the latter, that is, said groove or said bead of the bottle neck must be provided at accurate positions, because the sealing engagement is made between the upper edge of the container and the inner surface of the top disk of the cap, which is not quite efficient for large capacity bottles or for large diameter bottle necks.

One other tearable cap is shown and described in U.S. Pat. No. 3,392,860 to Faulstich, patented July 16, 1968, which also contains a vertically extending pull tab and a diagonal or slanting score line continued by a small circumferential score line, but the sealing engagement of this cap relies on the provision of an inner cylindrical flange which engages the inner surface of the bottle neck and said sealing engagement also relies on an outwardly directed or external hollow bead which is an arcuate portion provided at a predetermined position around the skirt of the cap, in order to insert within said hollow bead, the upper bead of the bottle neck. The external form of the cap, that is, the arcuate portion of the external bead provided on the skirt of the cap, renders series manufacture of said cap considerably difficult and also renders the sealing engagement relatively disengageable, because the arcuate thin portion of the skirt which provides the external bead of the cap of U.S. Pat. No. 3,392,860 does not provide a sufficiently strong engagement to maintain the cap permanently in its closed position, whereby said sealing engagement may be lost through misuse or other external causes, thus providing a rather unsafe cap for bottle necks, particularly if the bottles are of a large capacity or contain large diameter bottle necks.

Another embodiment of a tearable cap for a bottle neck is disclosed in U.S. Pat. No. 3,338,446 to Faulstich, patented Aug. 29, 1967, which is an improvement of the cap disclosed in U.S. Pat. No. 3,120,900 also to Faulstich, and which incorporates, as additional elements, a vertical pull tab having a short vertical score line followed by a slant score line and thereafter by a circumferential score line to tear the cap throughout the circumference, and said cap having rigidifying gussets for avoiding deformation of the cap and at the same time facilitating opening of the flask, and providing reclosure devices. This cap, however, again relies, for tight closure engagement, on the provision of internal accurately positioned beads, which are introduced in also accurately positioned grooves provided on the outer surface of the bottle neck, and complemented by an inner cylindrical flange which snugly fits the internal surface of the bottle neck, whereby both the manufacture of the tearable cap and the manufacture of the bottle neck must be of special characteristics and is rendered extremely difficult, in view of the fact that accurately positioning of the grooves and the beads is required.

Another tearable bottle cap is shown and described in U.S. Pat. No. 3,392,862 also to Faulstich, patented July 16, 1968, wherein said bottle cap is provided with a vertically extending pull tab which tears a vertical score line continued by a short slant score line followed by a partially circumferential slant line, but this bottle cap relies, for its sealing engagement with the bottle neck, on the provision of the above mentioned external hollow bead to insert the upper bead of the bottle neck thereinto, and rigidifying elements are provided on the top disk of the cap in order to avoid undue deflection thereof inwardly or outwardly of the bottom, so as to improve the safety of the sealing engagement of the hollow internal bead against the upper bead of a bottle neck, particularly of the high capacity type flasks. The defects of this tearable bottle cap, however, are the same as those described in connection with the bottle cap of U.S. Pat. No. 3,392,860, with the only exception that the sealing engagement of the external bead with the upper bead of the bottle neck is somewhat improved by the provision of the rigidifying elements of the top disk of the cap.

One other design of a tearable bottle cap is disclosed in U.S. Pat. No. 3,840,137 also to Faulstich, patented Oct. 8, 1974, which provides the same type of outer hollow bead to engage the upper bead of the bottle neck but which, for the first time, provides a bottle cap which may be used both with screw threaded or unthreaded neck bottles, by furnishing a sealing engagement which does not rely on the snug fit between the inner wall of the hollow bead and the upper bead of the bottle neck, but which relies on the provision of a plurality of circumferential ribs on the lower portion of the bead of the cap, in order to snugly fit around the bottle thus providing a sealing engagement which may be regarded as more secure. While this type of bottle cap may be ideally used for threaded neck bottles, because the top disk of the cap fits on the upper edge of the bottle neck, thus providing almost absolute stability of the bottle cap, the defect of having the top disk of the bottle cap directly seating in sealing engagement against the upper edge of the bottle neck, is very likely to produce breakage of said bottle neck when piling of the bottles one over the other is contemplated, as well as frequent breakage of the bottoms of the upper bottles piled, in view of the shocks received by careless handling. On the other hand, when this type of cap is used with unthreaded neck bottles, then there is a cushion left over the upper edge of the bottle neck, which suppossedly acts as a shock absorber which may avoid the above disadvantage, but the problem with this bottle cap is that, when the bottles are piled one over the other, the pressure exerted on the top disk of the cap may be sufficiently strong to flatten the top cushion and to dislocate the sealing engagement between the lower ribs of the outer bead of the cap and the upper bead of the bottle neck, thus defeating the purpose of the cap.

U.S. Pat. No. 3,979,002 also to Faulstich, and patented Sept. 7, 1976 discloses an improvement over the cap shown and described in U.S. Pat. No. 3,392,860, and also more particularly refers to an improvement to the bottle cap of U.S. Pat. No. 3,840,137, in that it is also suitable for serving to close both threaded and unthreaded neck bottles, but providing the sealing rib on the upper third portion of the external bead, which clearly is not the solution to the dislocation of the sealing engagement when the caps are used for unthreaded neck bottles and the bottles are piled and thus exert a pressure on the top disk of the cap of the bottle below, which tends to dislocate the sealing engagement thereof. Also, the bottle cap of U.S. Pat. No. 3,979,002, when used with threaded neck bottles, while perfectly sealing the said bottle, is also likely to produce breakage in view of the fact that it does not provide any cushion which may serve as a shock absorber against breakage of the upper edge of the bottle neck or of the bottom of the bottles piled above.

From the above, it may be concluded that, while the provision of an outer hollow bead on a bottle neck may be of relatively economical construction because it involves the use of less material than an internal solid bead, said external beads do not provide a completely safe sealing engagement, particularly when the bottle caps are to be suitable for use with both threaded and unthreaded neck bottles and particularly when, as is common in handling the bottles, they are piled one over the other with the consequent risks of breakage of the bottles when they are threaded neck bottles or of dislocation of the sealing engagement when they are unthreaded neck bottles.

However, while the solid inner beads provide for a better sealing engagement than the outer hollow bead, it has been very well known that, for the provision of an inner bead, it is mandatory to provide a complementary groove on the bottle neck, accurately positioned thereon in order to receive the inner bead of the bottle neck, and it is also mandatory to provide either sealing circumferential ribs on the top disk of the bottle, or a pressure fit between the inner surface of said top disk of the bottle cap and the upper edge of the bottle. This, obviously, rendered it impractical to use a bottle cap provided with an internal bead, both with threaded and unthreaded neck bottles.

Finally, U.S. Pat. No. 4,303,167 to Francisco P. Martinez, patented Dec. 1st, 1981, describes a bottle cap which, being provided with the advantages of having the sealing characteristics of an internal solid bead, is also capable of being useful both for threaded or unthreaded neck bottles, and provides for a cushion to avoid breakage of the necks or of the bottoms of piled bottles, which up to the present date has been provided only by the unsafe outer hollow beads disclosed in the above mentioned patents to Faulstich. According to Martinez, the above action is carried out by the provision of a solid inner bead for being engaged with the lower portion of the upper bead of the bottle neck, and a plurality of inwardly radially directed projections in the skirt, which extends from the upper disk down to such a position that their lower ends serve as stops for the upper portion of the upper bead of the bottle neck, thus accomplishing a full-proof closure, as well as a rigid skirt which will not tend to be deformed when the bottles are piled.

While the cap of the above identified U.S. Pat. No. 4,303,167 practically solves all the problems of the caps of the prior art, said cap shows the drawbacks that occasionally, for instance, when several bottles are piled one above the other or when an undue pressure is exerted on the upper disk of the cap, it suffers a slight side distorsion of the projections, whereby the hermeticity of the cap may be destroyed when the inner bead is separated from the lower part of the upper bead of the bottle neck. Therefore, with this type of caps of U.S. Pat. No. 4,303,167, it has been recommended not to pile a large number of bottles, since otherwise the resistance of the projections may be exceeded and the hermiticity of the cap may be destroyed to a certain extent.

BRIEF SUMMARY OF THE INVENTION

Having in mind the defects of the prior art tearable bottle caps, it is an object of the present invention to provide a tearable bottle cap which, while providing an absolutely safe sealing engagement, will be useful both for threaded and unthreaded neck bottles, without any of the disadvantages shown by the tearable bottle caps of the prior art.

It is another object of the present invention to provide a tearable bottle cap of the above mentioned character, which will contain a shock absorbing cushion which will be effective both with threaded and unthreaded bottles and which will not dislocate the sealing engagement when used with unthreaded neck bottles.

It still another object of the present invention to provide a tearable bottle cap of the above mentioned character, which will be of a very economic and simple construction and of a very efficient performance.

Another and more particular object of the present invention is to provide a tearable bottle cap of the above described character, which will contain stiffening elements for the shock absorbing cushion, as well as a stop for avoiding the dislocation of the sealing engagement between the cap and the bottle neck.

One other object of the present invention is to provide a tearable bottle cap of the above mentioned character, which will be provided with a nearly cylindrical outward shape, which will prevent undue trapping of protrusions of the bottle cap which may tend to inadvertently dislocate the sealing engagement thereof with the bottle neck.

The foregoing objects and other ancillary thereto are preferably accomplished as follows:

According to a preferred embodiment of the present invention, a cylindrical bottle cap comprising a top disk and a depending skirt, is provided with a first circumferential inner bead arranged at a distance from said disk such that it will engage the lower portion of the upper bead of a bottle neck, particularly of large capacity threaded or unthreaded neck bottles, a second inner bead arranged at a short distance from said first inner bead, for engaging the upper portion of the upper bead of the bottle neck, and a plurality of vertically extending lugs extending from said disk downwardly to a distance such that their lower ends will be embedded or merged with said second inner bead, to the reinforced thereby and to achieve a completely tight engagement of said internal bead against the lower portion of the upper bead of the bottle neck, regardless of the pressure exerted on the top of the cap. Also, said desk is provided with a circumferential rib extending downwardly of the inner surface thereof, in order to serve as an additional shock absorber when the cap is used with the threaded neck bottles, said circumferential rib also serving as an additional sealing engagement of the cap against the bottle. The plurality of lugs provided on the upper portion of the tearable bottle cap of the present invention, duly reinforced by the second inner bead, of which they form an integral part, prevent the pressure exerted by piling of the bottles one above the other from deforming the shock absorbing cushion formed on the top of unthreaded neck bottles, because they will transmit said pressure through said second inner bead, unto the upper edge of the bottle neck, through a soft material which serves also as a shock absorber and prevents dislocation of the sealing engagement of the internal bead of the cap with the upper bead of the bottle neck.

BRIEF DESCRIPTION OF THE DRAWINGS

The novel features that are considered characteristic of the present invention are set forth with particularly in the appended claims. The invention itself, however, both as its organization and its method of operation, together with additional objects and advantages thereof, will best be understood from the following description of a specific embodiment, which read in connection with the accompanying drawings, in which:

DETAILED DESCRIPTION

Figure 1:
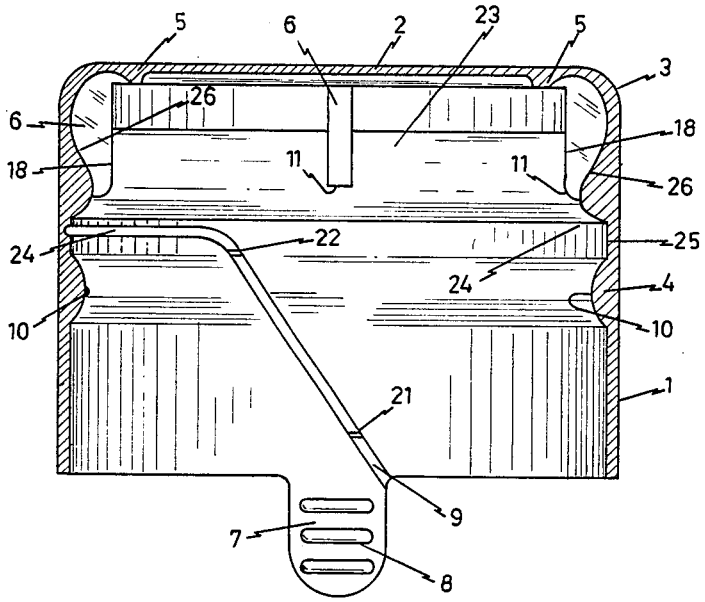
FIG. 1 is a cross-sectional elevational view of a tearable bottle cap built in accordance with the present invention and showing the internal beads and the upper lugs which provide for a secure sealing engagement and for a top shock absorbing cushion to avoid breakage of the bottles when are piled above each other.
Figure 2:
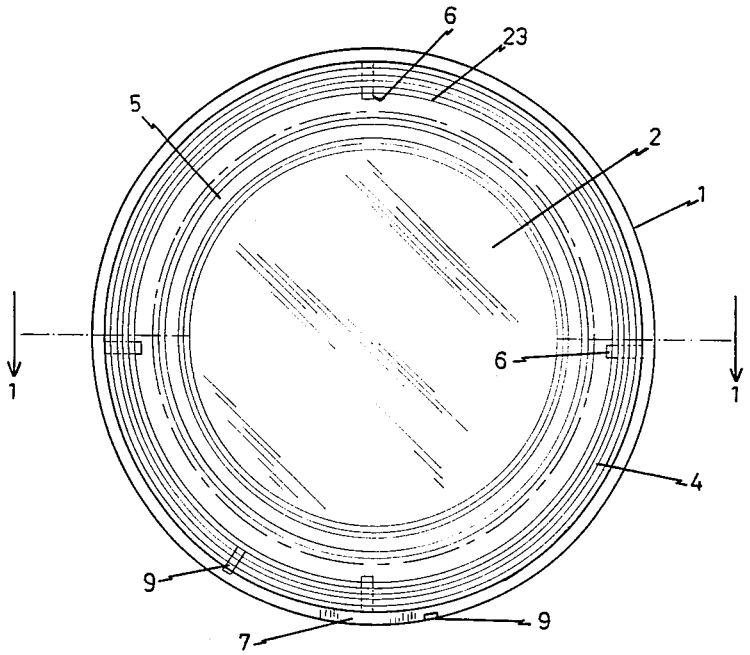
FIG. 2 is a bottom plan view of the tearable bottle cap shown in FIG. 1 of the drawings.

Having now more particular reference to FIGS. 1 and 2 of the drawings, there is shown a tearable bottle cap in accordance with a particularly preferred embodiment of the invention, which essentially comprises a top disk 2, joined through an arcuate edge 3 to a depending skirt 1, the skirt 1 being of a nearly cylindrical configuration and being provided with an internal bead 4 having an semicylindrical cross section and extending throughout the circumference of the inner surface of skirt 1, for the purpose of being engaged snugly over the lower portion of the upper bead of a bottle neck as will be described in more detail hereinbelow.

The skirt 1 of the bottle neck is also provided with a plurality of lugs 6 equidistantly arranged throughout the circumference thereof and extending downwardly of the top disk 2 as more clearly shown in FIG. 1 of the drawings, the slanting lower edges 11 of the lugs 6 being merged or embedded within a second inner bead 23 which reinforces and stiffens said lugs, said lugs also serving as a stop for the upper edge of the upper bead of the bottle neck, in order to provide a practically immovable snug pressure fit between said internal bead 4 and the upper bead of the neck as will be also described in more detail hereinafter. The radial width of lugs 5 from the inner surface of the skirt 1 is such that they will allow accomodation of the terminal screw threaded portion of a threaded neck bottle, in order to provide for the usefulness of the device both with unthreaded and with threaded neck bottles.

The inner bead 23 has an approximately triangular cross-section in order to accomplish a higher reinforcement of lugs 6, said inner bead 23 having a hypotenuse 26 which slants downwardly and inwardly and a lower base 24 which is of an arcuate nature, in order to engage the upper portion of the upper bead of the bottle neck, the latter being engaged within a depression 25 between beads 4 and 23, as will be described in more detailed hereinbelow.

The skirt 1 of the cap of the present invention is provided with the customary and well known slant score line 9, extending from the lower edge of the skirt 1 and up past the body of the internal bead 4, and then circumferentially along depression 25, and a pull tab 7 extends downwardly of the lower edge of said skirt 1, with one of the side edges of said pull tab coinciding with the point where the slant score line 9 starts, in order to provide an element for tearing the bottle cap along the score line 9 and loosening the same for the purpose of removing it from the bottle neck. As is also well known in the art, the pull tab 7 is provided with a plurality of antiskid ribs 8, to provide for a secure grasp for tearing the cap.

In order to more safely maintain the sealing engagement between the internal bead 4 of the cap and the upper head of the bottle neck, a partition wall 22 may be provided within the score line 9 covering the full cross sectional area thereof, above said internal bead, and one other partition wall 21 is similarly arranged within the score line 9 at a point near the lower edge of the skirt 1, thus permitting a fast and expedite removal of the cap, but still maintaining the leak-proof closure unaltered.

Figure 3:
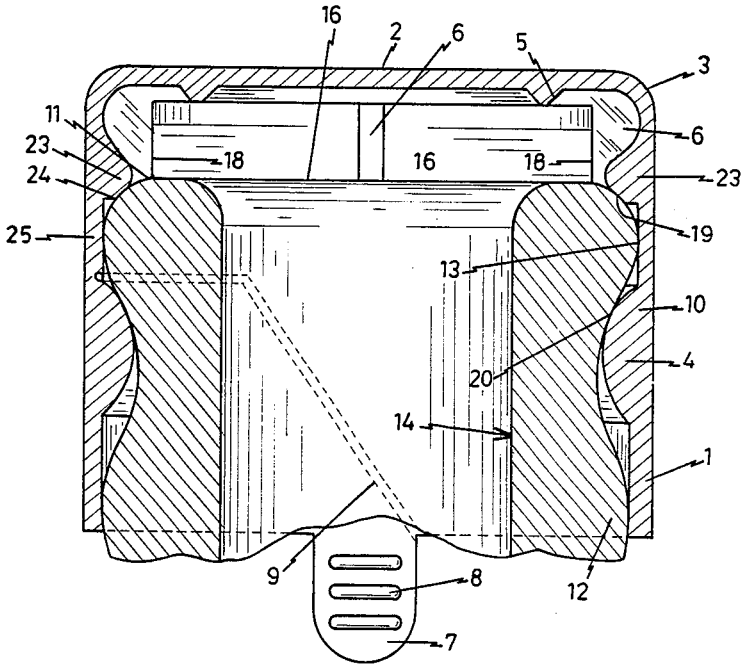
FIG. 3 is a fragmentary cross-sectional elevational view of the tearable bottle cap built in accordance with the present invention, engaged over an unthreaded neck bottle and being drawn loose for clarity purposes only.
Figure 4:
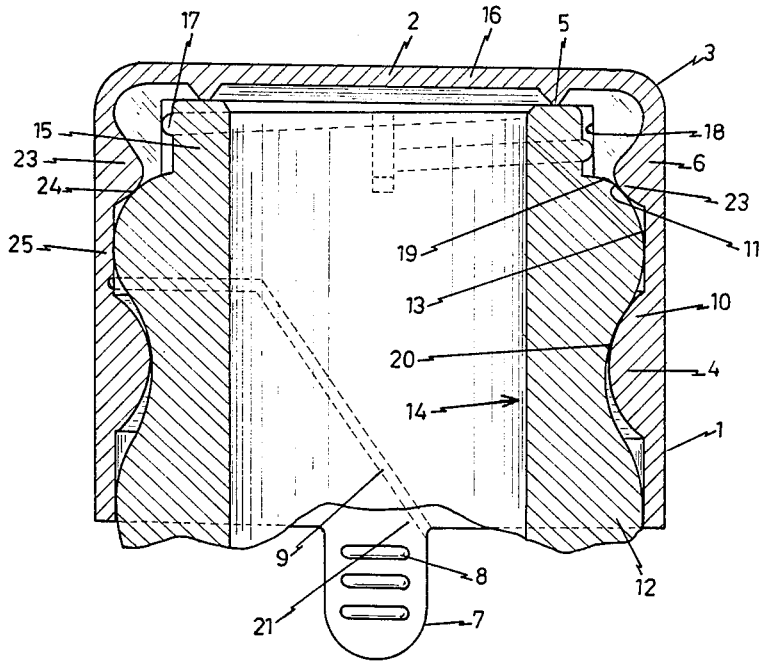
FIG. 4 is a fragmentary cross-sectional elevational view of the bottle cap built in accordance with the present invention, engaged over a threaded neck bottle in order to show the usefulness of the cap with both types of bottles.

The tearable bottle cap built in accordance with the above, is of a very simple construction and of a very economic manufacture, and still provides for an absolutely safe sealing engagement and an absolutely safe shock absorbing cushion, to avoid breakage of the bottles on which the cap is used, as will be described in terms of its engagement with an unthreaded neck bottle as shown in FIG. 3 of the drawings, and with a threaded neck bottle as shown in FIG. 4 of the drawings.

Having now more particular reference to FIG. 3 of the drawings, the tearable bottle cap built in accordance with the present invention is shown as engaged to an unthreaded neck bottle, the cap having been drawn loose for purposes of clarity of description only, but it must be understood that the fit of the cap around the bottle neck is quite tight in order to provide for a completely safe sealing engagement to avoid the possible leak of the liquid contained in said bottle.

The cap built in accordance with the present invention is inserted around the bottle neck 14 which generally comprises a lower bead 12 and an upper bead 13, particularly when dealing with large capacity bottles, such as water bottles, and by so inserting the cap around the bottle neck 14, the lower edge of the skirt 1 snugly engages the lower bed 12 of the neck 14, whereas the internal bead 4 of the skirt 1, snaps downwardly into the neck bottle, forming an absolutely safe sealing engagement between the upper third portion of the internal bead 4 of the cap, and the lower arcuate portion 20 of the upper bead 13 of the bottle neck, as is clearly shown in FIG. 3 of the drawings.

The insertion of the cap built in accordance with the present invention is permitted to be effected downwardly to a distance such that the sealing engagement between the bead 4 and the bottle neck bead 13 is absolutely safe, by the provision of said second inner bead 23 at a position suitable for forming a channel or depression 25, within which the bead 13 of the bottle neck will be engaged, in view of the fact that, when the cap is in strictly sealing position, the lower edge 24 of the bead 23 firmly abuts against the upper arcuate portion of the upper bead 13 of the neck 14, so as to form a leak-proof stop to maintain portion 10 of the inner bead 4 of the cap, firmly and snugly secured against the lower arcuate portion 20 of the upper bead 13 of the bottle neck 14, while the lower edge of the skirt 1 is also snugly fit around the arcuate portion of the lower bead 12 of said neck.

By having the upper edge 16 of the bottle neck 14 completely free except for the abutting engagement against the lower edge 24 of the inner bead 23, a very effective shock absorbing caushion is provided, in view of the fact that the top disk 2 of the cap remains completely spaced from the upper edge 16 of the bottle neck 14, and effectively absorbs all the shocks caused by piling the bottles one over the other, but without showing the drawbacks of the prior art shock absorbing cushions, because this cushion 21 cannot be deformed regardless of the pressure exerted by the piled bottles (within reasonable limits) because the lugs 6, duly reinforced by the approximately triangular inner bead 23, also serves as stiffening members for the upper portion of the skirt 1, which on the one hand cannot be inserted further inwardly of the bottle neck 14, which might dislocate the sealing engagement between the internal bead 4 and the upper bead 13 of the bottle neck, and on the other hand cannot also be deformed to dislocate said sealing engagement by misplacement of the sealing elements described above.

The lugs 6 reinforced by bead 23, which forms a very important part of the present invention, are provided not only for the purpose of stiffening the upper portion of the skirt 1 and the top disk 2 in order to provide a practically undeformable air cushion above the upper edge 16 of an unthreaded neck bottle, but are also provided for the purpose of accomplishing, in view of the position of the lower edge 24 of bead 23, the positioning of the internal bead 4 of the skirt 1 such that it will be very firmly fit against the upper bead 13 of the bottle neck, for the purposes of providing an absolutely and undislocatable leakage proof tight closure between the cap and the bottle.

The cap built in accordance with the present invention, as described above, may be removed from the bottle neck shown in FIG. 3 by merely grasping the pull tab 7 and tearing along the score line 9, past the thick internal bead 4, in order to loosen the cap and enable removal thereof from the bottle neck.

Now having reference to FIG. 4 of the drawings, it will be seen that the cap of the present invention may also be used with threaded neck bottles, in view of the fact that the inner vertical edges 18 of lugs 6 are arranged at a distance such that they will accomodate the upper terminal threaded portion 16 of the bottle neck 14, as clearly shown in FIG. 4 of the drawings.

As also clearly shown in FIG. 4 of the drawings, the terminal portion 15 of the bottle neck 14 is received within the space left by lugs 6, and said lugs 6, together with the inner beads 4 and 23, accomplish the sealing engagement exactly the same as described in connection with FIG. 3 of the drawings, but in addition said terminal portion 15 of neck 14, raises the upper edge 16 of the bottle neck to a position such that it engages the circumferential rib 5, providing an additional sealing engagement against said rib, as well as an undeformable shock absorbing element, in view of the fact that the rib 5 is flexible and will not produce breakage of the upper edge 16 of the bottle neck. The thread 17 of the terminal portion 15 of the bottle neck abuts against the inner edges 18 of the lugs 6, thereby providing an absolutely immovable engagement between the cap and the bottle, particularly at the upper portion thereof, so as to prevent breakage of the terminal portion 15 of the bottle neck, by inadverted sidewardly directed impacts of the bottle neck against other bottles when they are being handled or piled one above the other.

From the above it may be seen that a completely safe tearable cap has been provided, that will accomplish a perfectly leak proof sealing engagement with the bottle neck, and at the same time will be useful both for threaded and unthreaded neck bottles, also providing a shock absorbing cushion which is undeformable by being suitably supported by a plurality of lugs suitably reinforced by means of a bead having an approximately triangular cross section which serves as a stop for the skirt, and at the same time provides a sealing engagement between an internal bead and the upper bead of the bottle neck, whereby the nature of said sealing engagement is considerably improved. Also, despite the thickness of the inner beads provided within the skirt of the cap of the present invention, tearing of the same for easy removal of the cap is accomplished by extending the score line past the lower internal bead, which is possible with the cap of the present invention due to the provision of at least two partition walls for plugging the full cross section of said score line, which fully and tightly close the portion of the cap where the score line extends, against the wall of the bottle neck, with a leak proof engagement prior to tearing.

Although certain specific embodiments of the present invention have been shown and described above, it is to be understood that many modifications thereof are possible. The present invention, therefore, is not to be restricted except insofar as is necessitated by the prior art and by the spirit of the appended claims.

What is claimed is:

1. A tearable bottle cap for large capacity bottles comprising a top planar disk, an approximately cylindrical skirt depending from said planar disk to snugly fit around the neck of the bottle, a slant score line starting at the lower edge of said skirt, a pull tab projecting downwardly of said lower edge of the skirt, one of the side edges of the pull tab being arranged to terminate at the point of said lower edge of the skirt where the score line starts, a first inner solid bead having an arcuate surface and extending throughout the circumference of said skirt at a predetermined distance from said top disk, in order to engage the lower portion of the upper bead of a bottle neck, a second solid inner bead extending throughout the circumference of said skirt and at a predetermined distance above said first solid inner bead for forming a channeled depression therebetween in order to trap in said depression the upper bead of the associated bottle neck, a plurality of vertical, radially inwardly directed lugs projecting from the inner surface of said skirt from said top disk to said second solid inner bead and having their lower edges as well as part of their lengths embedded within said second solid inner bead to be reinforced thereby, said lugs being equidistantly distributed around the periphery of said disk and having a width such that they will accomodate therebetween the upper terminal portion of a threaded bottle neck, said radially inwardly directed lugs together with said second solid inner bead serving as a rigidifying assembly for the upper portion of the cap in order to provide a shock absorber when the cap is used with unthreaded neck bottles, and a circumferential internal rib projecting from the inner surface of said top disk, said internal rib being of a diameter such that the upper edge of the terminal portion of a threaded neck bottle will abut thereon, in order to serve as a shock absorber for the upper edge of the bottle neck when the cap is used with threaded neck bottles, said radially inwardly directed lugs serving as rigidifying elements of the upper portion of the cap by abutment of the outer edges on the threads of the terminal portion of the threaded neck bottle, in order to avoid sidewardly directed movements of the cap.

2. A tearable bottle cap for large capacity bottles according to claim 1 wherein said lugs are provided in a number of 4, and are equidistantly distributed around the circumference of the tearable bottle cap.

3. A tearable bottle cap according to claim 2 wherein said lugs have straight vertical inner edges, the spacing between each pair of opposite lugs at their inner edges being such that they will abut against the threads of a threaded neck bottle, but will permit the insertion of said cap within said bottle.

4. A tearable bottle cap according to claim 2 wherein said second solid inner bead has an approximately triangular cross-section, with a hypotenuse inclined downwardly and inwardly of said skirt so as to reinforce said lugs, and with a lower arcuate base adapted to abut over the upper portion of the upper bead of an unthreaded bottle neck, in order to prevent insertion of the cap beyond the position in which a tight closure between the internal bead of the cap and the upper bead of the bottle neck is accomplished.

5. A tearable bottle cap according to claim 1 wherein the length of said depending skirt is such that its lower edge will snugly fit around the outermost portion of the lower bead of the bottle neck.

6. A tearable bottle cap according to claim 1 wherein said score line extends upwardly of the lower edge of the skirt past said first solid inner bead whereby to facilitate tearing and removal of the cap, at least one partition wall being transversely arranged within said score line to fully cover the cross sectional area thereof in order to secure the leak proof engagement of said cap at the section thereof where said score line extends.

7. A tearable bottle cap according to claim 6 wherein one said partition wall is provided within the score line above said first solid inner bead and one other partition wall is similarly provided below said first solid inner bead.

* * * * *